United States Patent [19]

Burkhart et al.

[11] 4,005,922

[45] Feb. 1, 1977

[54] REPLACEABLE ELECTRICAL CONNECTOR PLUG ASSEMBLY

[75] Inventors: James G. Burkhart, Dallas; Montgomery P. Burkhart; James D. Coley, both of Rockwall, all of Tex.

[73] Assignee: Air-Tex Wire Harness, Inc., Mesquite, Tex.

[22] Filed: June 2, 1975

[21] Appl. No.: 582,975

[52] U.S. Cl. ..... 339/59 M; 339/107; 339/196 M

[51] Int. Cl.² ..... H01R 13/10

[58] Field of Search ..... 339/59–63, 339/107, 191, 192, 196, 206–209, 210, 28, 29

[56] References Cited

UNITED STATES PATENTS

| | | | |
|---|---|---|---|
| 1,794,777 | 3/1931 | Kliegl | 339/196 M |
| 3,375,481 | 3/1968 | Parnell | 339/107 |
| 3,518,617 | 6/1970 | Bosworth et al. | 339/206 P |
| 3,748,632 | 7/1973 | Tanges, Jr. | 339/196 R |

*Primary Examiner*—Joseph H. McGlynn

*Attorney, Agent, or Firm*—Richards, Harris and Medlock

[57] ABSTRACT

The specification discloses a replaceable electrical connector plug for attachment to a multi-wire cable. A rigid thermoplastic housing includes a front plug portion and a removable rear portion which forms a rear cavity. A set of first female electrical terminals are disposed in the front of the front plug portion in order to receive male terminals which extend from a mating electrical socket. A second set of female electrical terminals are disposed in the rear of the front plug portion. The first and second sets of female terminals are electrically interconnected. Male terminals are connected to the ends of the multi-wire cable and are received within the second set of female terminals. The cable extends through the rear cavity. The removable rear portion may be selectively removed in order to enable replacing of the electrical connector plug when desired.

1 Claim, 6 Drawing Figures

REPLACEABLE ELECTRICAL CONNECTOR PLUG ASSEMBLY

FIELD OF THE INVENTION

This invention relates to electrical connector systems, and more particularly relates to a replaceable electrical connector plug for attachment to a multi-wire cable.

THE PRIOR ART

In an over-the-road tractor trailer, it is necessary to supply power from the electrical system of the tractor to the trailer in order to operate the trailer lights, anti-skid devices and the like. Heretofore, cables and connector systems have been provided which include metal plugs and socket housings in order to interconnect the electrical cable between the tractor and the trailer. Such previously developed systems have not been completely satisfactory, due to deterioration of the metal housings from rust and corrosion. Moreover, such prior cables have been quite difficult to replace upon the occurrence of deterioration, and often the entire plug and cable assembly must be discarded and replaced with a new assembly. A need has thus arisen for an electrical connector plug system wherein the plug is not subject to deterioration, and which is easily replaceable and adapted for easy attachment to existing systems.

SUMMARY OF THE INVENTION

In accordance with the present invention, a replaceable electrical connector system includes a rigid housing having a removable rear portion which forms a rear cavity. Electrical connectors are provided in the front of the housing for connection to first electrical wires. First terminals are attached to the housing and face toward the rear of the housing adjacent the rear cavity. The first terminals are electrically connected to the electrical connectors. Second terminals are connected to second electrical wires and extend into the rear cavity for mating with the first terminals.

In accordance with another aspect of the invention, a replaceable electrical connector plug for attachment to a multi-wire cable includes a rigid thermoplastic housing having a front plug portion and a removable rear portion which forms a rear cavity. First female electrical terminals are disposed in the front of the front plug portion to receive male terminals extending from a mating electrical socket. Second female electrical terminals are disposed in the rear of the front plug portion and structure electrically connects the first and second female terminals. Male terminals are provided to be connected to the ends of the multi-wire cable and are received within the second female terminals when the removable rear portion is removed. Portions of the multi-wire cable extend through the rear cavity of the housing and through an opening formed between the removable rear portion and the housing when the removable rear portion is attached to the housing.

In accordance with yet another aspect of the invention, a replaceable electrical connector plug assembly includes a rigid outer housing of rigid synthetic polymer having a front plug portion and a rear cable attachment portion. A first set of female terminals are disposed in an array in the front of the housing in order to receive male terminals extending from a mating socket. A second set of female terminals are disposed in an array in the rear of the housing and face the cable attachment portion. The first and second sets are electrically connected. An elastomeric plug core is disposed within the plug portion of the outer housing and surrounds the first and second sets of female terminals. A cable having a plurality of wires extends from the ends thereof. Male terminals are attached to each of the wires and are received by the second set of female terminals. The cable extends through the cable attachment portion. A cover is rigidly attached over the cable attachment portion of the housing to cover and protect the connections between the wires and the male terminals.

DESCRIPTION OF THE DRAWINGS

For a more detailed description of the present invention and for further objects and advantages thereof, reference is now made to the following description taken in conjunction with the accompanying drawings, in which.

DESCRIPTION OF THE PREFERRED EMBODIMENT

Figure 1:
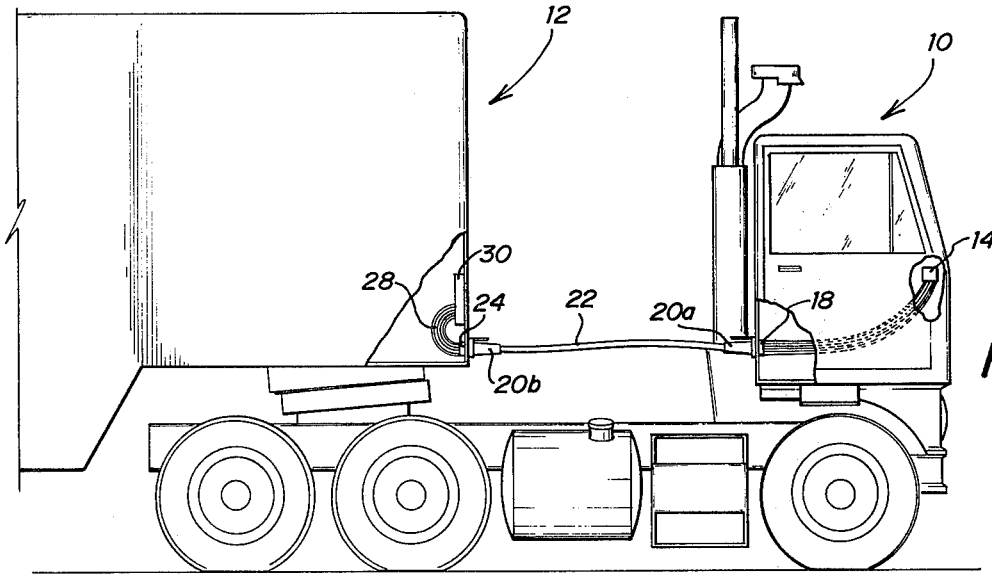
FIG. 1 is a somewhat diagrammatic illustration of the insulation of an electrical connection system utilizing the present invention in an over-the-road tractor-trailer.

Referring to FIG. 1, an over-the-road tractor is generally designated by the numeral 10 and is connected in the conventional manner for towing a large trailer generally designated by the numeral 12. It is necessary to supply power from the electrical system of the tractor 10 to the trailer 12 in order to operate lights on the trailer, anti-skid devices, and the like. A fuse box 14 is normally located on the tractor 10 and, in accordance with the present invention, a plurality of wires 16 are directed from the fuse box 14 to a socket 18 connected through the rear wall of the tractor 10.

Male terminals in the socket 18 interconnect with female terminals in a plug **20*a* which is interfitted with the socket 18. A rubber cable 22 contains a plurality of electrical wires which extend from the female terminals in plug 20*a* to similar female terminals in plug 20*b*. Plugs 20*a* and 20*b* are identical and are integrally molded over the ends of cable 22 to form a unitary watertight plug and cable unit. The electrical terminals in plug 20*b* receive male terminals in a second socket 24 which is mounted on the front wall of the trailer 12 and extends through an aperture therein. Wires 28 extend from the male terminals in the socket 24 to a terminal box 30 which is mounted in the trailer 12. Electrical connections are made from the terminal box 30 to the lights, anti-skid devices and other electrical devices requiring power in the trailer 12** in the conventional manner.

Although the present invention is illustrated as being utilized with a tractor-trailer configuration, it will be understood that the present replaceable socket invention can be utilized on any of a plurality of types of electrical connection systems wherein a plug attached to a multi-wire cable is utilized.

The system shown in FIG. 1 is described in greater detail in co-pending patent application Ser. No. 568,922, filed Apr. 17, 1975, and entitled "Tractor-Trailer Electrical Connector System", and assigned to the present assignee. As disclosed in the co-pending patent application, the plugs and socket are integrally molded from plastic material and are therefore not subject to deterioration by corrosion or the like. When the plugs illustrated in FIG. 1 are desired to be replaced, or alternatively, when it is desired to replace a conventional metal plug, the present invention may be utilized in order to enable the replacement of a plug without throwing away the existing plug and cable structure.

Figure 2:
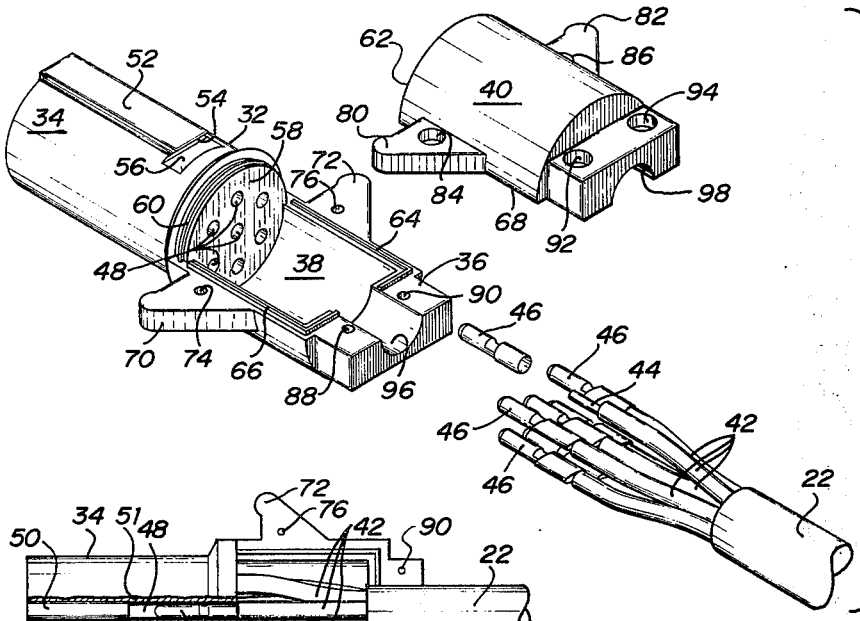
FIG. 2 is an exploded perspective view of the present invention.

The replaceable plug structure of the invention is illustrated in the exploded view in FIG. 2. The present plug assembly comprises a rigid housing 32 made of rigid synthetic polymer. Housing 32 includes a front plug portion 34 and a rear portion 36 which forms a cavity 38. As shown in FIG. 2, the rear face of the plug housing 34 has formed therein a plurality of female terminals 48. A removable cover 40 is adapted to be interfitted with rear portions 36. The end of cable 22 is illustrated in FIG. 2 as being cut away to expose a plurality of electrical wires 42. The ends 44 of the electrical wires are stripped of insulation and are attached as by crimping or the like to metal male terminals 46.

Figure 3:
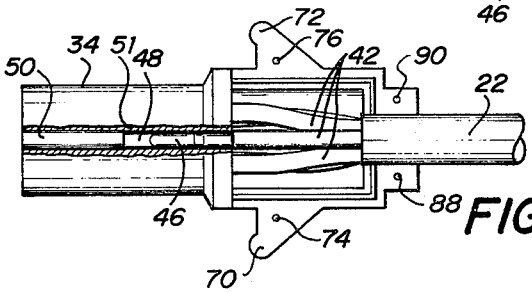
FIG. 3 is a top view, partially broken away, of the present replaceable plug assembly.
Figure 4:
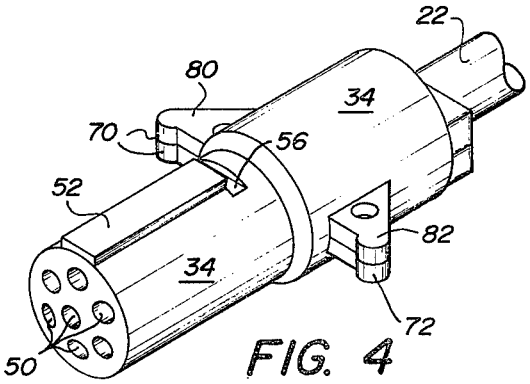
FIG. 4 is a perspective view of the assembled plug of the invention.

FIG. 3 illustrates a partially broken away view of the front plug portion 34 and illustrates one of the female terminals 48. Further, a plurality of larger female terminals 50 are mounted in an array on the front face of the front plug portion 34. As shown in FIG. 3, the female terminals 48 are electrically connected with the larger female terminals 50. In the embodiment shown in FIG. 3, the smaller female terminals 48 are crimped to the ends of the female terminals 50. In an alternate embodiment, the terminals may be connected by wires which are soldered at the ends thereof to their respective terminals. FIG. 4 illustrates the assembled plug and illustrates the array of female terminals 50 located in the front face of the front plug portion 34.

An important aspect of the present invention is that the interior portion of the front plug portion 34 is filled with elastomeric material 51. PBC Vinyl has been found to work well in practice. The core 51 not only protects the electrical connections between the terminals 46 and 50, but provides a unitary watertight support housing for the terminals.

In construction of the housing, the elastomeric core material 51 is formed by injection molding in the preferred shape. The core including the terminals 48 and 50 is then placed in another injection mold and the rigid outer housing forming the front plug portion 34 is formed thereabout by injection molding. The outer housing may be formed from any suitable rigid synthetic polymer such as high density nylon, polyethylene, polycarbonate, or the like.

Referring again to FIG. 2, it will be seen that the front plug portion 34 is generally cylindrical, with the exception of an elongated member 52 formed along the top of the plug portion 34. Elongated member 52 terminates in an abutting surface 54. A groove 56 is formed at the end of the elongated portion 52. As will be subsequently described, groove 56 and abutment 54 serve to retain the plug within a socket.

The rear face 58 of the front plug portion 34 is circular, with the female terminals 48 arranged in a symmetrical arrangement. In the illustrated embodiment, seven female terminals are provided. A rim 60 is provided about the upper half periphery of the face 58 and is provided with a groove configuration. This groove configuration interfits with a matching groove configuration upon the inner lip 62 of the cover 40. Projections 64 and 66 extend along the edges of the rear plug portion 36 and interfit with grooves formed in the underside 68 of the cover 40. Wings 70 and 72 are formed on opposite sides of the rear plug portion 36 and include screw apertures 74 and 76 therein, respectively. Wing portions 80 and 82 are formed on the cover 40 and also include screw apertures 84 and 86.

In addition, screw holes 88 and 90 are formed in the rear of the rear plug portion 36. Corresponding screw holes 92 and 94 are formed in the rear portion of cover 40. A circular cutout 96 is formed in the back of the rear plug portion 36. A corresponding semicircular cutout 98 is formed in the rear of the cover 40. Cutouts 96 and 98 form a circular aperture shape to receive cable 22 in the manner to be subsequently described.

FIG. 3 illustrates how the present replacement plug is utilized to replace an existing plug. The existing plug may be cut off by severing the cable where the cable joins the existing plug. The cable is then stripped back to expose a plurality of wires 42. The ends of the wires 42 are then stripped and male plugs 46 are crimped thereon in the manner shown in FIG. 2. The male plugs 46 are then inserted into the female terminals 48 in the manner shown in FIG. 3. The wires 42 are disposed within the cavity 38 and the cable 22 is disposed through the cutout 96. The cover 40 is then disposed on the housing and screws are applied through screw holes 74, 76, 88 and 90 in order to rigidly attach cover 40. The unit thus is watertight and ruggedly assembled. The plug may then be assembled into a mating socket, with the female terminals 50 receiving male terminals in the known manner.

FIG. 4 illustrates a perspective view of the completely assembled plug of the invention. It will be seen that the wings 72 and 82 mate to form an integral wing, and wings 70 and 80 mate to form a second integral wing. The wings are utilized to manually pull the plug from a socket connection.

Figure 5:
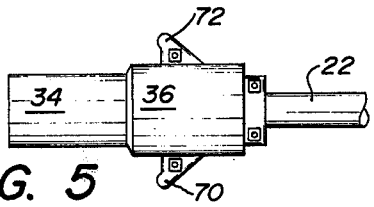
FIG. 5 is a bottom view of the assembled plug shown in FIG. 4.

FIG. 5 illustrates a bottom view of the assembled plug, illustrating the nuts which receive the connecting bolts in order to tightly assemble the device into an integral unit.

Figure 6:
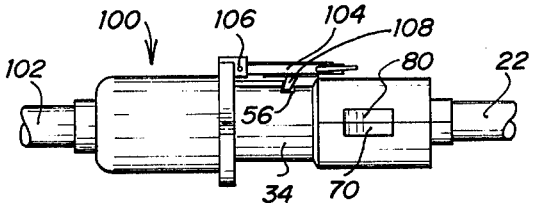
FIG. 6 is a side view of the present plug when attached with a socket in accordance with the invention.

FIG. 6 illustrates the interconnection of the present plug into a socket 100. Socket 100 is connected to a cable 102 and includes a plurality of male terminals mounted therein. The male terminals mounted threin are received within the female terminals 50 of the plug housing 34. The socket 100 includes a lid 104 pivotally connected by pivot 106. Lid 104 includes a projection 108 which is received within groove 56 in order to maintain the plug in the desired position. When it is desired to remove the plug, lid 104 is raised slightly and the plug is pulled from connection with the socket 100.

For a more detailed description of the socket 100, reference is made to the co-pending patent application Ser. No. 568,922, filed Apr. 17, 1975 previously described.

It will thus be seen that the present invention provides an electrical plug which may be easily attached to the existing connector systems, without discarding the attachment cable. The assembled plug may be easily attached and yet provides a rigid and watertight connection.

Whereas the present invention has been described with respect to specific embodiments thereof, it will be understood that various changes and modifications will be suggested to one skilled in the art, and it is intended to encompass such changes and modifications as fall within the scope of the appended Claims.

What is claimed is:

1. A replaceable electrical connector plug assembly for use in a tractor cab-trailer electrical connector system comprising:

a rigid unitary housing having a front plug portion and a rear cable attachment portion;

said rear cable attachment portion including a semicircular hollow cavity having a semicircular aperture extending through the rear end thereof and edge projections extending along the top edges of said cavity, said rear cable attachment portion further including a rear rectangular extension, having a semicircular aperture extending therethrough in alignment with said hollow cavity semicircular apertures, and side wings extending from and integral with said rear cable attachment portion;

a first set of female terminals having first and second ends, disposed in an array in the front of said front plug portion wherein said first ends of said first set of female terminals receive male terminals extending from a mating socket;

a second set of female terminals having first and second ends, disposed in an array in the rear of said front plug portion;

said first ends of said second set of female terminals being electrically connected to said second ends of said first set of female terminals and said second ends of said second set of female terminals being accessible from said hollow cavity, and elastomeric material completely surrounding said first and second sets of female terminals within said front plug portion; a detachable plug cable having a plurality of wires freely extending from the end thereof;

male terminals attached to each of said wires;

an end portion of said detachable plug cable dimensioned to extend through said semicircular apertures in said hollow cavity and said rear rectangular extension for direct mechanical connection of said male terminals to said second ends of said second set of female terminals, said detachable plug cable being detachable for replacement thereof and being linearly aligned with said first and second sets of female terminals; and a removable semicircular cover portion for said hollow cavity of said rear cable attachment portion, said cover having a semicircular aperture and edges for mating with said semicircular aperture of said hollow cavity to enclose said detachable plug cable end portion;

said cover further including a rear rectangular extension having a semicircular aperture extending therethrough in alignment with said cover semicircular aperture for mating with said semicircular aperture in said rear cable attachment rear rectangular extension to provide a strain relief for said end portion of said detachable plug cable, side wings extending from and integral with said cover for mating with said side wings of said rear cable attachment portion, and said edges of said cover including grooves for interfitting with said cavity edge projections, said cover being attached to said rear cable attachment portion by screws and being selectively removable to permit assembly and disassembly of said plug cable to said second ends of said second set of female terminals and providing protection for the connection between said plug cable end portion and said second set of female terminals when said cover is assembled to said rear cable attachment portion of said housing.

* * * * *